US007104857B1

(12) United States Patent
Swan et al.

(10) Patent No.: US 7,104,857 B1
(45) Date of Patent: Sep. 12, 2006

(54) METHOD FOR CONTROLLING A HYDRAULICALLY ASSISTED STEERING SYSTEM OF A MARINE VESSEL

(75) Inventors: Allen F. Swan, Mayville, WI (US); Jeremy L. Alby, Oshkosh, WI (US); Brian L. Fisher, Oakfield, WI (US)

(73) Assignee: Brunswick Corporation, Lake Forest, IL (US)

( * ) Notice: Subject to any disclaimer, the term of this patent is extended or adjusted under 35 U.S.C. 154(b) by 84 days.

(21) Appl. No.: 10/965,565

(22) Filed: Oct. 14, 2004

(51) Int. Cl.
*B63H 5/125* (2006.01)

(52) U.S. Cl. ..... 440/615

(58) Field of Classification Search ..... 440/61 S, 440/61 C, 61 A; 477/15, 19, 20, 111; 701/41, 701/53
See application file for complete search history.

(56) References Cited

U.S. PATENT DOCUMENTS

| | | | | |
|---|---|---|---|---|
| 5,251,722 | A * | 10/1993 | Scratchard | 180/321 |
| 5,340,341 | A | 8/1994 | Yoshimura | 440/61 |
| 5,376,029 | A | 12/1994 | Entringer et al. | 440/61 |
| 5,427,555 | A | 6/1995 | Merten | 440/61 |
| 6,598,553 | B1 | 7/2003 | Hundertmark | 114/150 |
| 6,715,438 | B1 | 4/2004 | Hundertmark | 114/144 R |
| 2004/0173135 | A1 | 9/2004 | Watanabe et al. | 114/144 R |

* cited by examiner

*Primary Examiner*—Ed Swinehart
(74) *Attorney, Agent, or Firm*—William D. Lanyi

(57) ABSTRACT

A hydraulically assisted steering system provides a controller which activates a hydraulic pump when a manual throttle selector handle is in either forward or reverse gear selector positions, but deactivates the pump when the handle is in a neutral gear selector position. A controller can also interrogate an ignition key to make sure that it is in an ON position and also respond to the activation of a manual switch which can be used to override the deactivation step of the pump.

19 Claims, 2 Drawing Sheets

METHOD FOR CONTROLLING A HYDRAULICALLY ASSISTED STEERING SYSTEM OF A MARINE VESSEL

BACKGROUND OF THE INVENTION

1. Field of the Invention

The present invention is generally related to a hydraulically assisted steering system for a marine vessel and, more particularly, to a method for utilizing a hydraulic pump and associated electric motor in an efficient way which can have the effect of allowing smaller capacity alternators than would otherwise have to be used in conjunction with the hydraulically assisted steering system.

2. Description of the Prior Art

Various types of hydraulic steering systems are known to those skilled in the art for use in conjunction with marine vessels and, more particularly, in conjunction with pleasure craft.

U.S. Pat. No. 6,715,438, which issued to Hundertmark on Apr. 6, 2004, describes a tiller operated power assist marine steering system. The tiller is preferably coupled to the outboard motor or other steering element of a watercraft such that movement of the tiller in a first manner imposes manually generated steering forces on the steering element and that operation of the tiller in a second manner imposes power assist steering forces on the steering element.

U.S. patent application Ser. No. 10/702,560, which was filed on Nov. 7, 2003 by Watanabe et al., describes a power steering device for a boat with an outboard motor. To provide a power steering device which helps to realize easy drive with small steering force without taking waterproofness into consideration, a gear device is provided for driving a link mechanism for turning and steering an outboard motor main body at the rear of the boat body through a cable by a steering wheel. A steering torque input to the gear device by the steering wheel is detected by a torque sensor to assist drive the gear device in the steering direction by an electric motor, a helical pinion, and a helical wheel.

U.S. Pat. No. 6,598,553, which issued to Hundertmark on Jul. 29, 2003, describes a power assist marine steering system. The system includes a hydraulically actuated steering cylinder assembly and a helm. The helm has a high pressure port being coupled to a fluid pressure source, a return port coupled to the reservoir, and a metering port coupled to a second chamber of the steering cylinder.

U.S. Pat. No. 5,340,341, which issued to Yoshimura on Aug. 23, 1994, describes a power assisting mechanism for a marine propulsion unit. The steering and gear shift system comprises a single source of hydraulic power, a steering device, a gear shift member, steering and gear shift control mechanism connected to their respective members and first and second assist devices connected to the gear shift and steering control mechanism for power assist. A single substantially constant output hydraulic pump supplies an essentially constant level of fluid power for the first and second power assist devices to assist the operator in controlling the steering and gear shift controls.

U.S. Pat. No. 5,376,029, which issued to Entringer et al. on Dec. 27, 1994, discloses a control valve for a pressurized fluid operated system, such as a marine power steering system, and includes a housing having an inlet and at least one outlet with one or more work ports located therebetween. Pressurized fluid is supplied to the inlet, and a spool member is mounted within the housing for controlling the supply of pressurized fluid to a work performing system, such as the extendable and retractable rod of a hydraulic cylinder assembly. The spool member includes structure for blocking the one or more work ports when the spool member is in its neutral position when it is desired not to operate the system. This prevents the cylinder from being exposed to reservoir fluid when the spool member is in its neutral position.

U.S. Pat. No. 5,427,555, which issued to Merten on Jun. 27, 1995, describes a power steering system. The system is interposed between the steering helm and the propulsion unit and mounted remote from the propulsion unit, and further is hydraulically actuated in response to operative movement at the steering helm. A gear drive means, actuated in response to steering actuation at the helm, is operably connected to power steering assist means, comprising a hydraulic cylinder piston assembly and hydraulic fluid source.

The patents described above are hereby expressly incorporated by reference in the description of the present invention.

When a hydraulically assisted steering system is added, as an after-market component, to an existing marine propulsion system, the provision of hydraulic power for the system can require a level of electrical power that is greater than the magnitude of electrical power which can be easily generated by the existing alternator of the marine propulsion system. In other words, an existing alternator provided for an outboard motor may not have the capacity needed to generate the additional electric power necessary to operate a hydraulic pump and motor that provides hydraulic pressure for the hydraulically assisted steering system which is added, as a retrofit improvement, to the marine propulsion system.

Known types of retrofit hydraulically assisted steering systems typically operate in one of two common ways. In some systems, the hydraulic pump is constantly driven by an electric motor to generate hydraulic pressure continually, with excess hydraulic fluid being recirculated to a hydraulic fluid reservoir. Other systems utilize a pressure accumulator that is pressurized by the motor driven pump whenever the pressure within the accumulator falls below a preselected magnitude. As the pressure is used by the hydraulic steering system, the pressure in the accumulator decreases. When the pressure in the accumulator is reduced to a preselected minimum magnitude, a switch causes the motor driven pump to be activated to increase the pressure within the accumulator.

It would be beneficial if a retrofit hydraulically assisted steering system could be provided which does not require an accumulator and does not continually operate a motor driven pump which requires excessive electric power which is beyond the normal capacity of the alternator provided in the outboard motor.

SUMMARY OF THE INVENTION

A method for controlling a power steering system for a marine vessel, in accordance with a preferred embodiment of the present invention, comprises the steps of providing a first signal which is representative of the position of a gear selector of the marine vessel, providing a hydraulically assisted steering device, providing a hydraulic pump which is connected in fluid communication with the hydraulically assisted steering device, providing an electric motor which is connected in driving relation with the hydraulic pump, activating the electric motor when the first signal is indicative that the gear selector is not in a neutral gear selecting position, and deactivating the electric motor when the first signal is indicative that the gear selector is in the neutral gear selecting position.

The method of the present invention can further comprise the step of determining an elapsed time subsequent to the gear selector being moved into the neutral gear selecting position. This step can comprise the step of delaying the performance of the deactivation step for a preselected period of elapsed time subsequent to the gear selector being moved into the neutral gear selecting position.

A preferred embodiment of the present invention can further comprise the step of providing a manually operable signal generating device that provides a manually controlled signal, monitoring the manually controlled signal, and temporarily activating the electric motor when the manually controlled signal indicates a desire that the electric motor be activated regardless of whether the gear selector is not in a neutral gear selecting position or the gear selector is in the neutral gear selecting position. The temporarily activating step can be performed for any preselected period of time (i.e. three seconds) or, the temporarily activating step can be performed as long as the manually controlled signal indicates a desire that the electric motor be activated.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
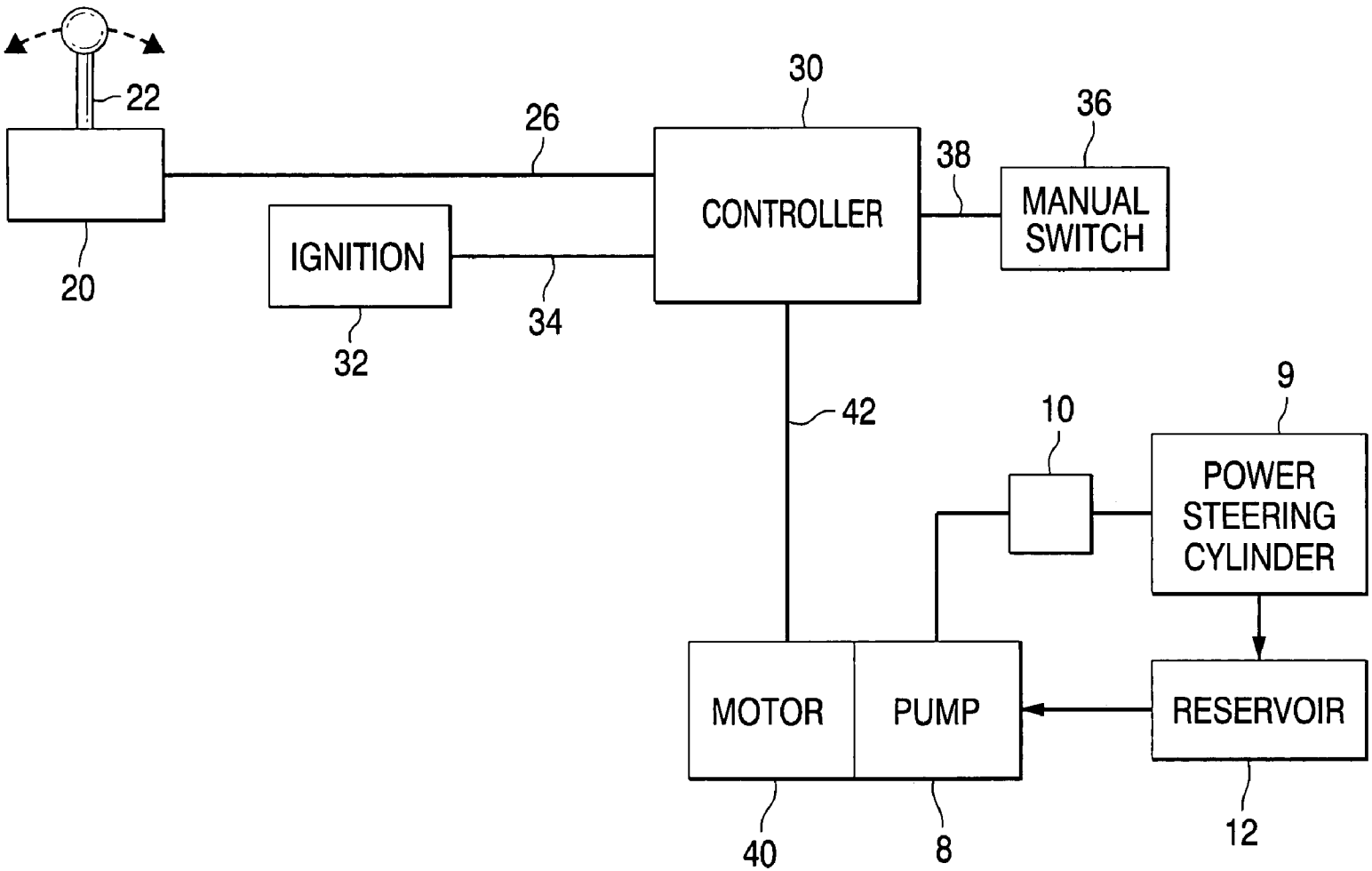
FIG. 1 is a schematic representation of a hydraulically assisted steering system with which the present invention can be used.

Throughout the description of the preferred embodiment of the present invention, like components will be identified by like reference numerals.

FIG. 1 is a schematic representation of a hydraulically assisted steering system for a marine vessel. A steering device, such as a steering wheel, is typically used to activate a control valve (e.g. a spool valve) which, in turn, controls the flow of pressurized fluid from a pump 8 to a power steering cylinder 9. This control component is schematically represented by the box identified by reference numeral 10 in FIG. 1. Pressurized fluid is thereby directed from the hydraulic pump 8 to the power steering cylinder 9 in response to movement of the steering device, such as a steering wheel. This type of system is generally known to those skilled in the art and will not be described in greater detail below. A reservoir 12 is typically used in conjunction with the pump 8.

In the illustration of FIG. 1, a manually operated throttle mechanism 20 has a handle 22 which is movable between forward, neutral, and reverse gear selector positions by moving the handle 22 as represented by the dashed line arrow in FIG. 1. A neutral gear selector position of the handle 22 provides a signal on line 26 to a controller 30. The controller 30 can be a microprocessor or a circuit which receives signals from the manually operated throttle device 20 and other components. In the system shown in FIG. 1, an ignition system 32 also provides a signal on line 34 to the controller 30. A manual switch 36 provides a signal on line 38 to the controller 30. In certain embodiments of the present invention, the controller 30 responds to the signal on line 34, which indicates that an ignition key is in an ON position and a signal on line 38 represents the activation of a manual switch 36, such as a push button, which indicates that the operator of the marine vessel wishes to activate the pump 8 and the power steering system in an override manner regardless of whether or not the controller 30 has determined that it is necessary to activate the hydraulic pump 8. This will be described in greater detail below. Also shown in FIG. 1 is an electric motor 40 which is used to power the hydraulic pump 8. A signal is provided on line 42 from the controller 30 to the motor 40 to activate the motor.

In a preferred embodiment of the present invention, the controller 30 reacts to a neutral gear selector position, as represented by the signal on line 26, and deactivates the motor 40 when the handle 22 is in the neutral gear selector position. Conversely, the controller 30 activates the motor 40 when the handle 22 is not in the neutral gear selector position. In other words, if the operator of the marine vessel moves the handle 22 in either a forward gear selector position or a reverse gear selector position, the motor 40 is activated to cause the pump 8 to generate hydraulic pressure for use by the power steering cylinder 9.

The basic philosophy under which the present invention operates is that hydraulic pressure is not generally needed by the power steering system when the handle 22 of the manual throttle system 20 is in a neutral gear selector position. Steering is not required in a marine vessel, in most situations, when the gear selector is not in either forward or reverse gear positions. Therefore, if the motor 40 is deactivated, less electrical power will be required. As a result, the alternator of the marine propulsion system is not required to provide that additional electric power when the power steering system is not in use. When the manual throttle control device 20 is placed in either forward or reverse gear positions, the present invention anticipates that a power steering system will be required, and the motor 40 is activated.

Two possible exceptions to this basic philosophy of operation exist. First, when the handle 22 is initially moved from either forward or reverse gear selector positions into the neutral gear selector position, the controller 30 can delay the deactivation of the motor 40 for a preselected period of time. This preselected period of time can be some constant time period, such as three or five seconds. This allows some maneuvering with the power steering system after the gear selector handle 22 has been moved into neutral position. This can be helpful during docking maneuvers as the operator of the marine vessel moves the handle 22 from forward or reverse gear selector positions into neutral and then back into one of the two operative gear selector positions, perhaps in a repeated manner.

A manual switch 36 can also be provided in certain embodiments of the present invention in order to override the normal operation described above. As an example, the operator of a marine vessel may desire to use a power steering system while the handle 22 is in a neutral gear position without necessarily being limited to the elapsed period of time described above. In these circumstances, a manual switch 36 can be provided. The manual switch 36 can be a push button which is activated by the operator of the marine vessel. A signal on line 38 can be followed by a preselected period during which the controller 30 maintains the motor 40 in an activated status. Alternatively, the controller 30 can maintain the activation status of the motor 40 as long as a signal is present on line 38 from the manual switch 36.

Figure 2:
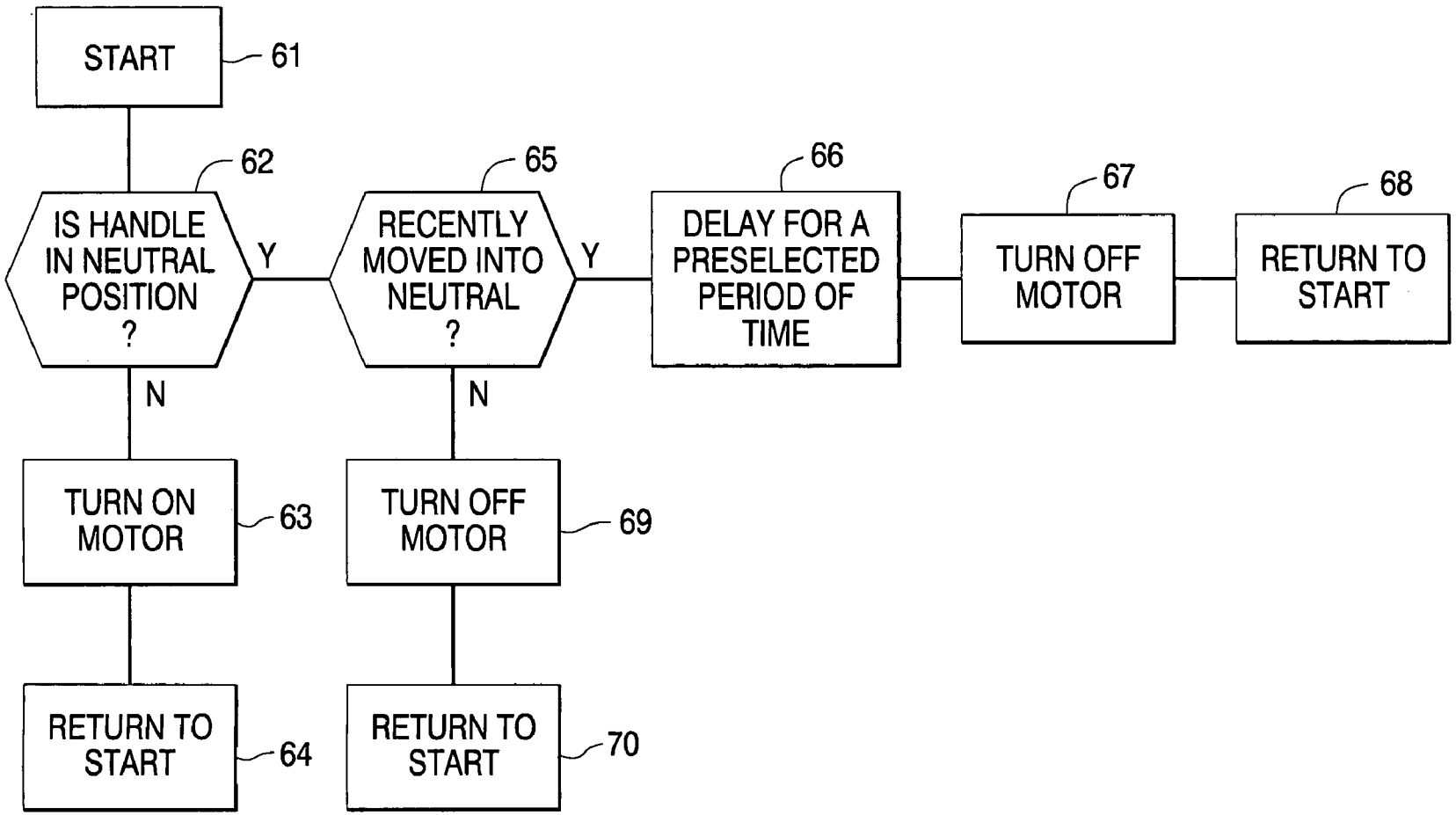
FIG. 2 is a simplified flowchart showing the basic steps of the method of the present invention.

FIG. 2 is a simplified flowchart showing the basic philosophy of operation of the present invention. Beginning at functional block 61, the process begins by interrogating whether or not the handle 22 is in its neutral gear selector position, as represented at functional block 62. If the handle 22 is not in the neutral position, the motor is turned on at functional block 63 and the system returns to the start position, as represented at functional block 64. If, on the other hand, functional block 62 determines that the handle is in the neutral position, it determines whether or not it was recently moved into the neutral position, as represented at functional block 65. Immediately after the handle 22 is moved into the neutral position, as described above, a preselected period of time, as illustrated at functional block 66, leaves the motor 40 in an activated state to allow final docking maneuvers. Then the motor is turned off as illustrated at functional block 67 and the system returns to the start position, as illustrated at functional block 68. If, as determined at functional block 65, the handle 22 has not recently moved into the neutral gear selector position, the motor 40 is turned off at functional block 69 and the system returns to the start position at functional block 70.

As described above, the delay following a movement of the handle 22 into the neutral position, can be a fixed number of seconds, such as three or five seconds. The use of the manual switch 36 essentially inhibits the operation of functional blocks 65–70 shown in FIG. 2. This can be limited to a number of seconds after activation of the manual switch 36 or, alternatively, can continue indefinitely as long as the manual switch 36 is activated.

Although not shown as a functional block in FIG. 2, the controller 30 can also use the ignition key signal on line 34 in a manner which prevents the operation of the motor 40, under any circumstance, without the key being in an ON position.

Although the present invention has been described in terms of an electric motor 40 used to drive the pump 8, it should be understood that the controller 30 can be used to control a clutch which can connect or disconnect the pump 8 from a belt driven relationship with the engine. Alternatively, other drive systems can be used in conjunction with the pump 8.

Although the controller 30 has been described in terms of being a microprocessor that performs a program to accomplish the steps shown in FIG. 2, it should be understood that an electric circuit, with discrete components, can be provided to perform these functions. For example, a switch in the throttle selection device 20 can provide a signal on line 26 that is combined with a signal on line 34 to logically respond when the handle 22 is in either a forward or a reverse gear selector position and the ignition key 32 is on. Furthermore, the logical combination of these signals on lines 26 and 34 can be used, in combination with an alternate signal on line 38 to activate the motor 40. In other words, the signal on line 38 can be combined with the signals on lines 26 and 34 to override those signals on lines 26 and 34 when the manual switch 36 is activated.

Although the present invention has been described with particular specificity and illustrated to show a preferred embodiment, it should be understood that alternative embodiments are also within its scope.

We claim:

1. A method for controlling a power steering system for a marine vessel, comprising the steps of:

providing a first signal which is representative of the position of a gear selector of said marine vessel;

providing a hydraulically assisted steering device;

providing a hydraulic pump which is connected in fluid communication with said hydraulically assisted steering device;

providing an electric motor which is connected in driving relation with said hydraulic pump;

activating said electric motor when said first signal is indicative that said gear selector is not in a neutral gear selecting position; and deactivating said electric motor when said first signal is indicative that said gear selector is in said neutral gear selecting position.

2. The method of claim 1, further comprising:

determining an elapsed time subsequent to said gear selector being moved into said neutral gear selecting position.

3. The method of claim 2, further comprising:

delaying the performance of said deactivation step for a preselected period of elapsed time subsequent to said gear selector being moved into said neutral gear selecting position.

4. The method of claim 1, further comprising:

providing a manually operable signal generating device that provides a manually controlled signal;

monitoring said manually controlled signal;

temporarily activating said electric motor when said manually controlled signal indicates a desire that said electric motor be activated regardless of whether said gear selector is not in a neutral gear selecting position or said gear selector is in said neutral gear selecting position.

5. The method of claim 4, wherein:

said temporarily activating step is performed for a period of greater than three seconds.

6. The method of claim 4, wherein:

said temporarily activating step is performed as long as said manually controlled signal indicates a desire that said electric motor be activated.

7. A method for controlling a power steering system for a marine vessel, comprising the steps of:

providing a first signal which is representative of the position of a gear selector of said marine vessel;

providing a second signal which is representative of the status of an ignition system switch;

providing a hydraulically assisted steering device;

providing a hydraulic pump which is connected in fluid communication with said hydraulically assisted steering device;

activating said hydraulic pump when said first signal is indicative that said gear selector is not in a neutral gear selecting position and said second signal is indicative that said ignition system switch is on; and deactivating said electric motor when said first signal is indicative that said gear selector is in said neutral gear selecting position.

8. The method of claim 7, further comprising:

delaying the performance of said deactivation step for a preselected period of elapsed time subsequent to said gear selector being moved into said neutral gear selecting position.

9. The method of claim 7, further comprising:

providing a manually operable signal generating device that provides a manually controlled signal;

monitoring said manually controlled signal;

temporarily activating said electric motor when said manually controlled signal indicates a desire that said electric motor be activated regardless of whether said gear selector is not in a neutral gear selecting position or said gear selector is in said neutral gear selecting position.

10. The method of claim 9, wherein:

said temporarily activating step is performed for a period of greater than three seconds.

11. The method of claim 9, wherein:

said temporarily activating step is performed as long as said manually controlled signal indicates a desire that said electric motor be activated.

12. A method for controlling a power steering system for a marine vessel, comprising the steps of:

providing a first signal which is representative of the position of a gear selector of said marine vessel;

providing a hydraulic steering device;

providing a hydraulic pump which is connected in fluid communication with said hydraulic steering device; and activating said hydraulic pump when said first signal is indicative that said gear selector is not in a neutral gear selecting position.

13. The method of claim 12, further comprising:

deactivating said hydraulic pump when said first signal is indicative that said gear selector is in said neutral gear selecting position.

14. The method of claim 12, further comprising:

providing an electric motor which is connected in driving relation with said hydraulic pump.

15. The method of claim 14, wherein:

said hydraulic pump actuating step is performed by activating said electric motor.

16. The method of claim 13, further comprising:

delaying the performance of said deactivation step for a preselected period of elapsed time subsequent to said gear selector being moved into said neutral gear selecting position.

17. The method of claim 12, further comprising:

providing a manually operable signal generating device that provides a manually controlled signal;

monitoring said manually controlled signal;

temporarily activating said electric motor when said manually controlled signal indicates a desire that said electric motor be activated regardless of whether said gear selector is not in a neutral gear selecting position or said gear selector is in said neutral gear selecting position.

18. The method of claim 17, wherein:

said temporarily activating step is performed for a period of greater than three seconds.

19. The method of claim 17, wherein:

said temporarily activating step is performed as long as said manually controlled signal indicates a desire that said electric motor be activated.

* * * * *